US007628652B2

(12) United States Patent
Ting

(10) Patent No.: US 7,628,652 B2
(45) Date of Patent: Dec. 8, 2009

(54) ELECTRICAL CARD CONNECTOR

(75) Inventor: Chien-Jen Ting, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/980,058

(22) Filed: Oct. 30, 2007

(65) Prior Publication Data

US 2009/0111307 A1 Apr. 30, 2009

(30) Foreign Application Priority Data

Oct. 30, 2006 (TW) ..... 95139969 A

(51) Int. Cl.
*H01R 24/00* (2006.01)

(52) U.S. Cl. ..... 439/630

(58) Field of Classification Search ..... 439/630
See application file for complete search history.

(56) References Cited

U.S. PATENT DOCUMENTS

| | | | | |
|---|---|---|---|---|
| 5,470,260 | A * | 11/1995 | Schwan et al. | 439/630 |
| 6,162,080 | A * | 12/2000 | Treibergs et al. | 439/268 |
| 6,641,441 | B2 * | 11/2003 | Liu | 439/630 |
| 2004/0137795 | A1 * | 7/2004 | Tsai | 439/630 |
| 2006/0040561 | A1 | 2/2006 | Chang | |

* cited by examiner

*Primary Examiner*—Tho D Ta
*Assistant Examiner*—Travis Chambers
(74) *Attorney, Agent, or Firm*—Andrew C. Cheng; Wei Te Chung; Ming Chieh Chang

(57) ABSTRACT

An electrical card connector includes a metal shield (1) defining a receiving room in which a memory card is insertable in a card insertion direction through an insert opening generally at a front end thereof, an insulated housing (2) shielded by the metal shield (1), and defining a receiving portion (240) extending therethrough and adjacent to a rear end thereof, and a terminal module (3) installed to the receiving portion (240), with a plurality of terminals (31) being preformedly insert-molded therein for electrical connection to the memory card.

3 Claims, 6 Drawing Sheets

ELECTRICAL CARD CONNECTOR

BACKGROUND OF THE INVENTION

1. Field of the Invention

The present invention relates generally to an electrical card connector, and particularly to such an electrical card connector installed to a printed circuit board.

2. Description of Related Arts

Memory cards are known in the art and contain intelligence in the form of a memory circuit or other electronic program. Some form of card reader reads the information or memory stored on the card. Such cards are used in many applications in today's electronic society, including video cameras, digital still cameras, smart phones, PDA's, music players, ATMs, cable television decoders, toys, games, PC adapters, multimedia cards and other electronic applications. Typically, a memory card includes a contact or terminal array for connection through a card connector to a card reader system and then to external equipment. The connector readily accommodates insertion and removal of the card to provide quick access to the information and program on the card. The card connector includes terminals for yieldingly engaging the contact array of the memory card.

The memory card connector often is mounted on a printed circuit board. The memory card, itself, writes or reads via the connector and can transmit between electrical appliances, such as a word processor, personal computer, personal data assistant or the like. With circuit board mounted connectors, the terminals of a connector include tail portions, which are connected to appropriate circuit traces on the printed circuit board by various systems, such as surface mount technology wherein the tail portions are reflow soldered to the circuit traces, or through hole technology wherein the tail portions of the terminals are inserted into holes in the printed circuit board for connection, as by soldering, to circuit traces on the board and/or in the holes.

For example, U.S. Pat. No. 5,470,260 has shown a conventional electrical card connector that includes an insulated housing, a switch terminal, terminal wheels projecting into the card-receiving room and received in the terminal-receiving slots of the connector, and a locking board fixing the connector onto the printed circuit board. Having been molded in the insulated housing, the terminal wheels are soldered onto the printed circuit board. During the soldering process, the high temperature may cause the insulated housing to warp, and an electrical performance of the whole connector may be affected for this reason.

Hence, an improved electrical card connector is desired.

SUMMARY OF THE INVENTION

Accordingly, an object of the present invention is to provide an electrical card connector with a preformed terminal module detachably assembled with the insulated housing.

Another object of the present invention is to provide an electrical card connector that can effectively prevent the insulated housing from warping.

To achieve the above object, An electrical card connector comprises a metal shield defining a receiving room in which a memory card is insertable in a card insertion direction through an insert opening generally at a front end thereof, an insulated housing shielded by the metal shield, and defining a receiving portion extending therethrough and adjacent to a rear end thereof, and a terminal module installed to the receiving portion, with a plurality of terminals being preformedly insert-molded therein for electrical connection to the memory card.

Other objects, advantages and novel features of the invention will become more apparent from the following detailed description when taken in conjunction with the accompanying drawings.

DETAILED DESCRIPTION OF THE PREFERRED EMBODIMENT

Figure 1:
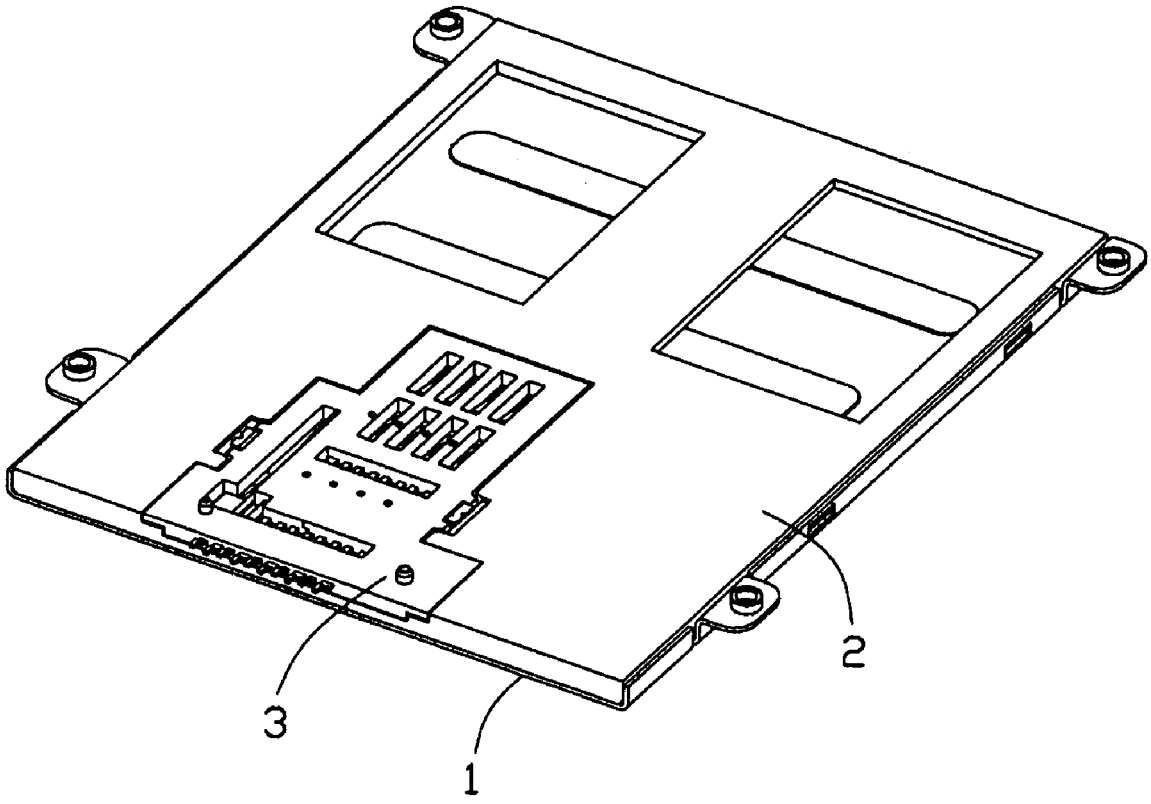
FIG. 1 is a perspective, assembled view of an electrical card connector in accordance with the present invention.
Figure 2:
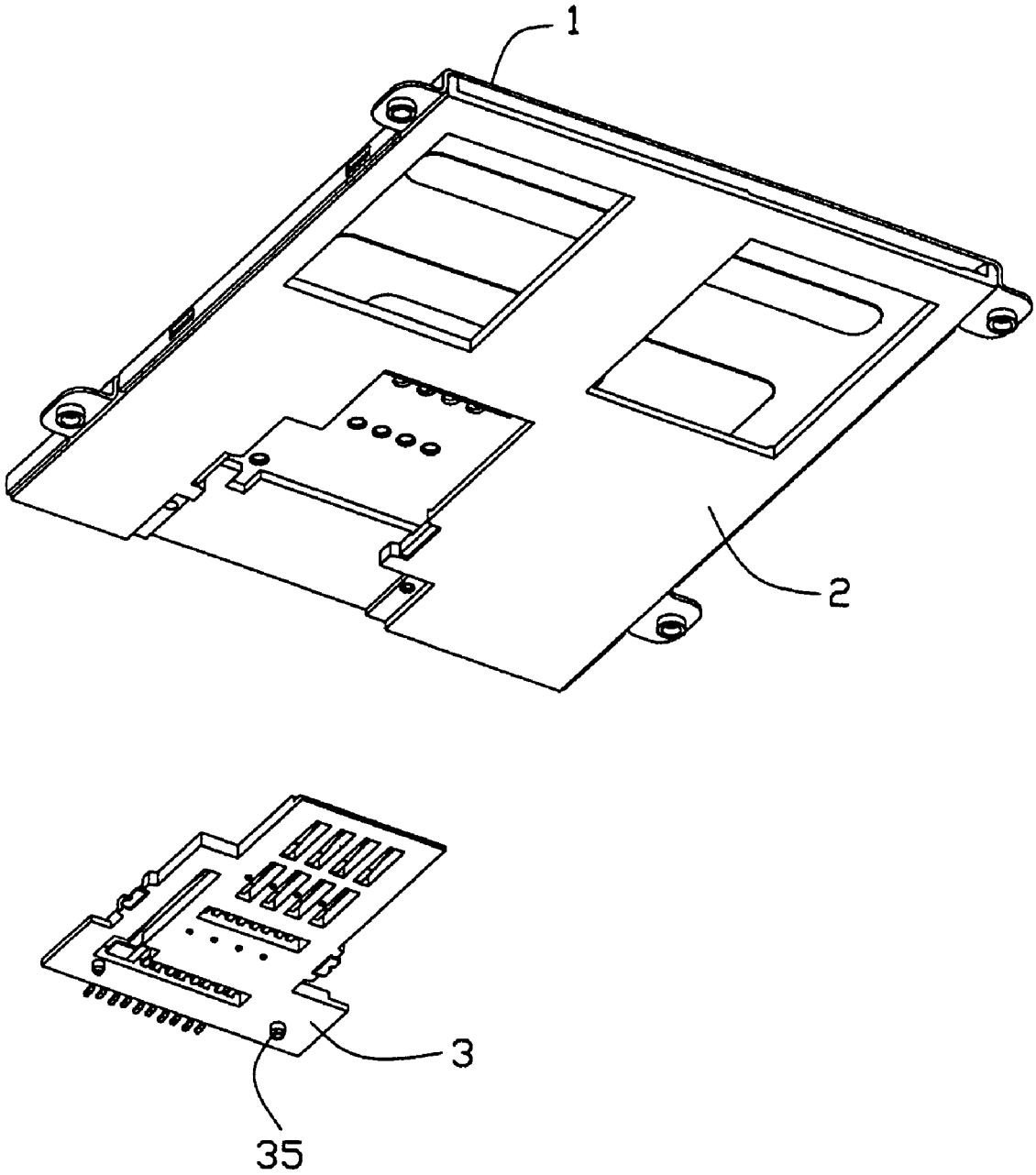
FIG. 2 is a perspective, exploded view of the electrical card connector.
Figure 3:
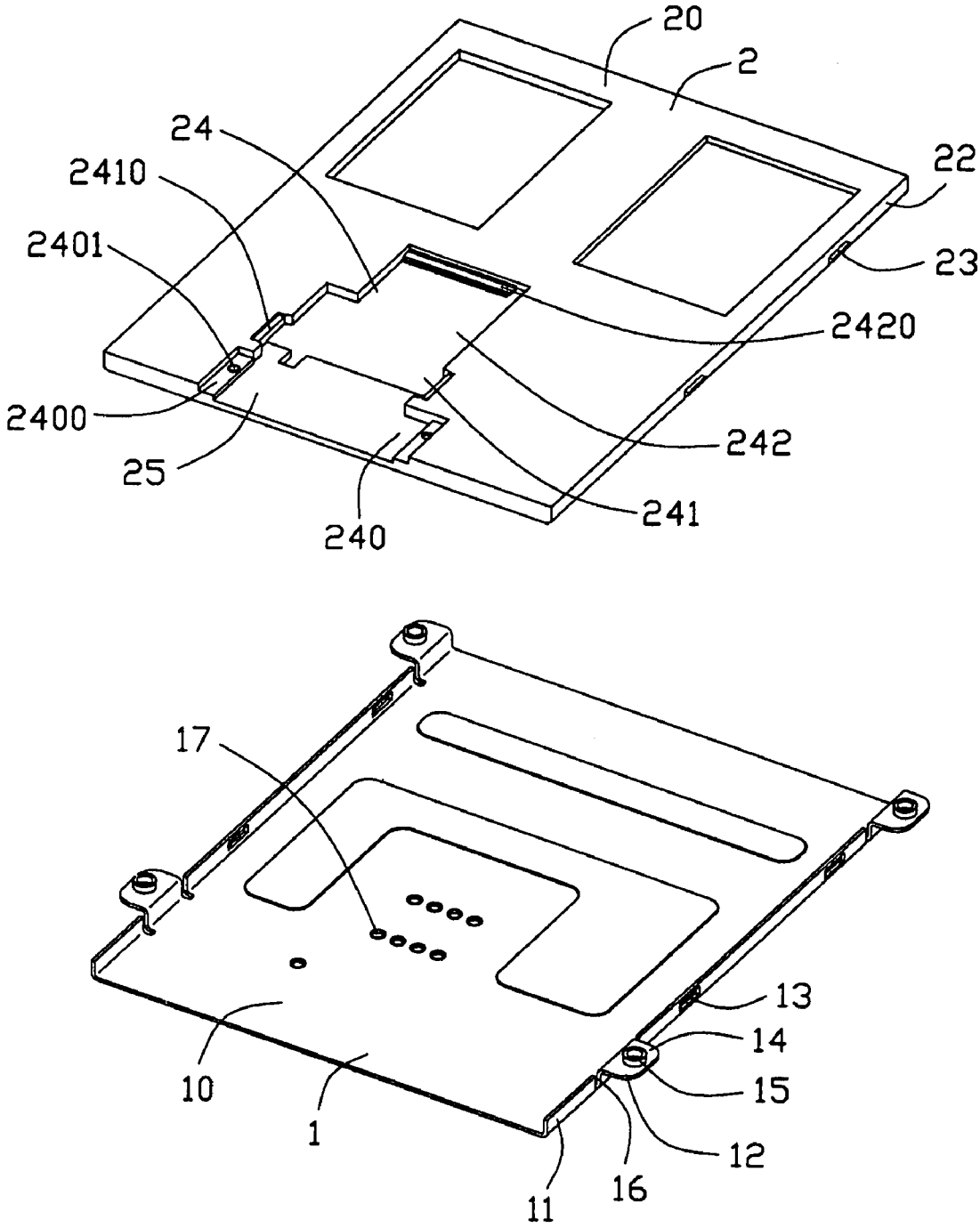
FIG. 3 is an exploded view of the metal shield and the insulated housing of the electrical card connector.
Figure 5:
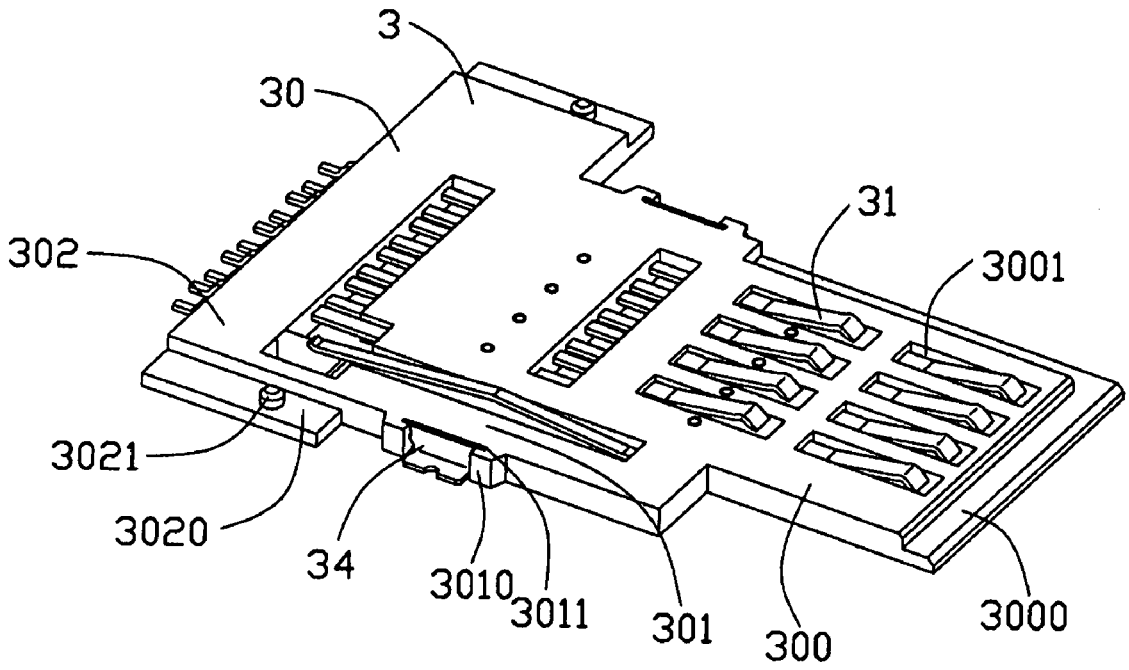
FIG. 5 is a perspective view of the terminal module of the electrical card connector.

Referring to FIGS. 1-3 in conjunction with FIG. 5, an electrical card connector according to a preferred embodiment of the invention comprises a metal shield 1, an insulated housing 2 and a terminal module 3 installed on the insulated housing 2. The metal shield 1 and the insulated housing 2 together define a receiving room (not labeled), which is used to receive an electrical card (not shown) and also a card insertion direction.

Figure 4:
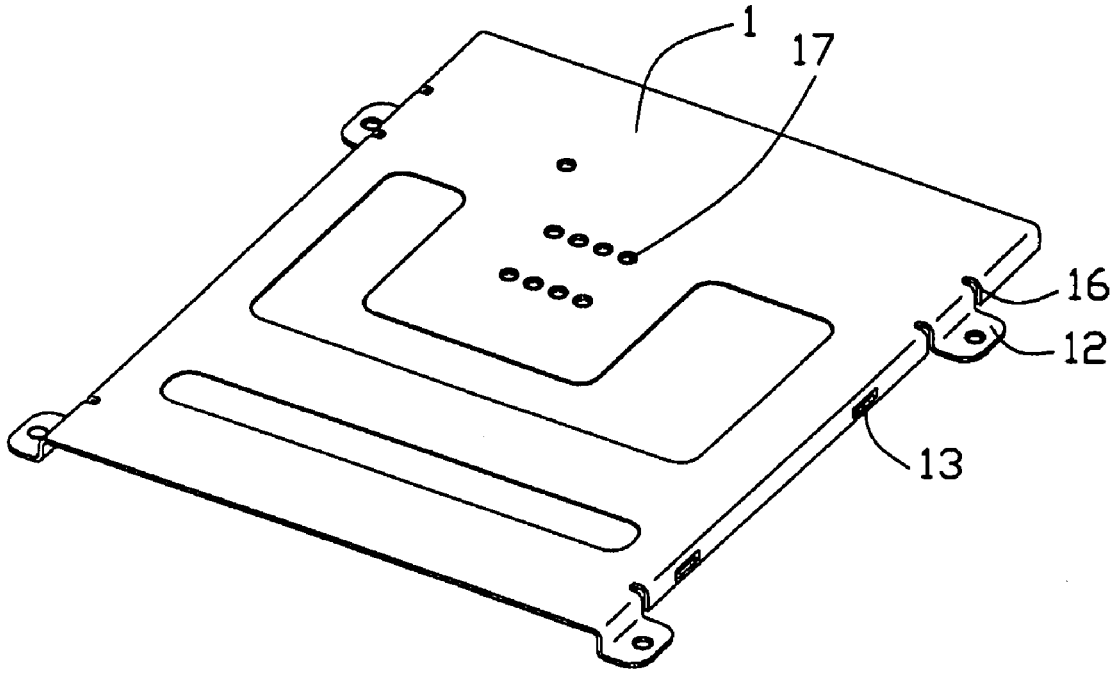
FIG. 4 is a view similar to FIG. 3, but taken from a different aspect.
Figure 4:
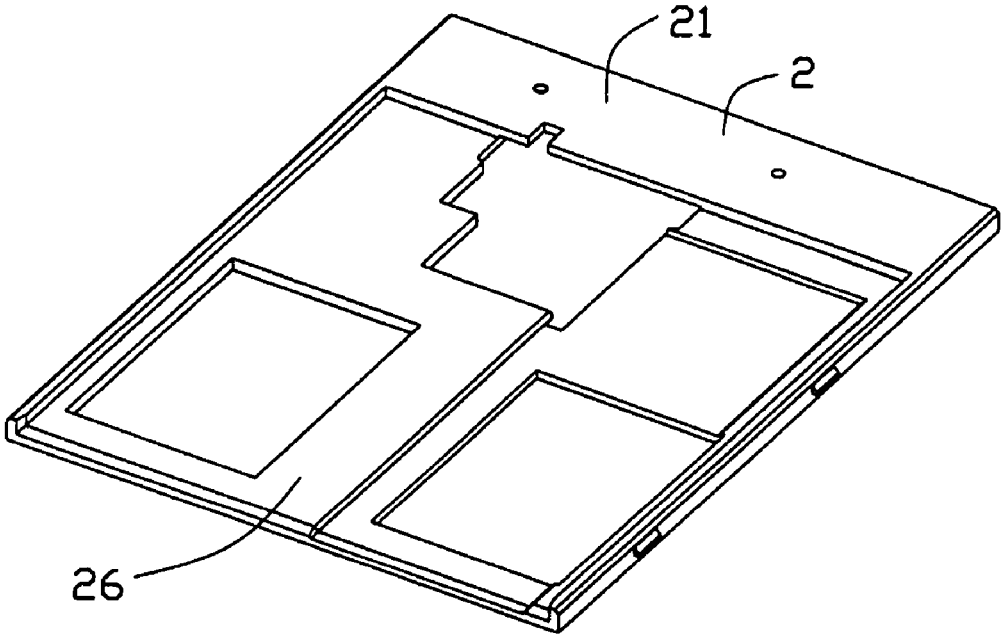

Referring to FIGS. 2-4, the metal shield 1 of a generally rectangular shape, comprises a base 10, two lateral sides 11 with a plurality of slots 13 formed thereon, extending vertically and upwardly from the sides of the base 10. A plurality of orientation pieces 12 extends horizontally and outwardly from the peak of the two lateral sides 11 forming a protrusive piece 15 of perforation configuration in order to assemble the metal shield 1 on a printed circuit board (not shown). Pluralities of notches 16 are arranged at the junctions between each lateral side 11 and the orientation pieces 12, so the lateral sides 11 are slightly tensile to make the insulated housing 2 easy to be shielded by the metal shield 1. Moreover, a plurality of through holes 17 forms on the base 10. The terms "vertically, upwardly and horizontally" are not meant to be limiting but is descriptive of depiction according to the claims.

Referring to FIGS. 2-4, the insulated housing 2 comprises an upper face 20, a lower face 21 and two lateral walls 22. A plurality of protruding portions 23 is formed on both the lateral walls 22 mating with the slots 13 of the metal shield 1 (or the protruding portions formed on the metal shield and the slots formed on the insulated housing). The upper face 20 is the mating surface of the insulated housing 2 and the printed circuit board, and at a rear end thereof along the card insertion direction forms a receiving portion 24 receiving the terminal module 3. The receiving portion 24 comprises a rectangle-receiving portion 240, a rectangular-receiving portion 241 and a L-shape receiving portion 242. Taken from a direction crossing the card insertion direction, the width of the rectangle-receiving portion 240 is larger than that of the rectangular-receiving portion 241. The rectangle-receiving portion 240 forms a pair of first step-shape pieces 2400 extending inwardly from both sides thereof. The first step-shape pieces 2400 are aligned with and stepped to a baffle board 25 (a back stepped portion) that is a part of the lower face 21, and furthermore, a pair of round holes 2401 is formed thereon. Similarly, the rectangular-receiving portion 241 forms a pair of second step-shape pieces 2410 extending inwardly from both sides thereof, and the L-shape receiving portion 242 forms a third step-shape piece 2420 extending from a forward part thereof along a direction opposite to the card insertion direction. The lower face 21 comprises a depressed portion 26 (a front stepped portion), so that the insulated housing 2 and the metal shield 1 integrally define said receiving room receiving the electrical card (not shown).

Figure 6:
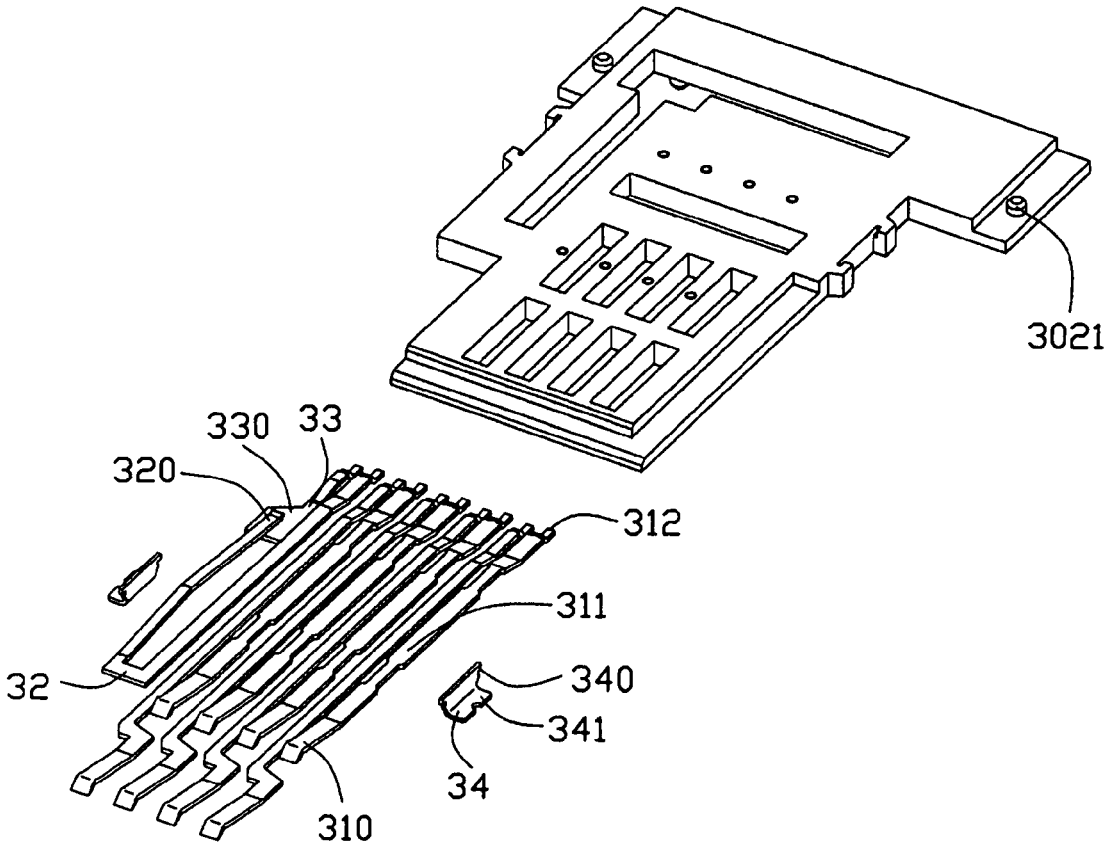
FIG. 6 is an exploded view of the terminal module.

Referring to FIG. 2 in conjunction with FIGS. 5-6, the terminal module 3 comprises a body portion 30 defining an upper surface (not labeled) and a lower surface (not labeled), and the upper surface is defined as the mating surface between the terminal module 3 and the inserted electrical card, while the lower surface is defined as the mating surface between the terminal module 3 and the printed circuit board. The terminal module 3 also comprises a plurality of signal terminals 31, a moveable terminal 32 and an immobile terminal 33 together defining a switch terminal (not labeled), a pair of metal ears 34 and a protrusion 35 formed on the mating surface between the terminal module 3 and the printed circuit board to fix said two parts firmly.

The body portion 30 comprises a rectangle portion 302 with a largest width thereof crossing the card insertion direction, a rectangular portion 301 extending forwardly from the rectangle portion 302 with the a width smaller than that of the rectangle portion 302 and a L-shape portion 300 extending continuatively and forwardly from the rectangular portion 301. The rectangle portion 302 comprises a pair of first tongue portions 3020 extending sideward from its sides thereof. The first tongue portions 3020 mates with the pair of the first step-shape pieces 2400, and forms outshoots 3021 thereon mating with the corresponding round holes 2401, so as to fix the terminal module 3 to the insulated housing 2. The rectangular portion 301 forms a pair of locking portions 3010 on both sides, and each forms a groove 3011, through which the metal ear 34 is attached thereto. The L-shape portion 300 comprises a second tongue portion 3000 extending forwardly from a forward part thereof and mating with the third step-shape piece 2420 of the insulated housing 2. Two rows of receiving recesses 3001 being in a linear array along the card insertion direction are formed on the L-shape portion 300 of the body portion 30.

Said signal terminals 31 comprise contacting portions 310 mating with the corresponding contacts (not shown) of the inserted electrical card, linking portions 311 and rear portions 312 soldered to the printed circuit board. The signal terminals 31 form a set of first terminals (not labeled) and a set of second terminals (not labeled) laterally located relative to the first terminals with contacting portions bending laterally and located at a front of that of the second terminals along the card insertion direction. The two rows of the signal terminals 31 are respectively received in the corresponding receiving recesses 3001. Said moveable terminal 32 forms a suppressing portion 320 cantilevered relative to a manual portion 330 of the immobile terminal 33. When the electrical card is inserted in so there is a force acting on the suppressing portion 320, the suppressing portion 320 and the manual portion 330 contacts, so that the signal transfers; when the force is removed, the suppressing portion 320 and the manual portion 330 flicks, and there are no signals. All the terminals 31, 32, 33 are insert-molded in the terminal module 3 preformedly. Each metal ear 34 comprises an erect surface 340 located in the corresponding groove 3011, and a horizontal surface 341 mating with the second step-shape piece 2410, whose opposite face is soldered to the printed circuit board. For the shape of the terminal module 3 is approximately the same as the shape of the receiving portion 24, the terminal module 3 is entirely received in the receiving portion 24.

While a preferred embodiment in accordance with the present invention has been shown and described, equivalent modifications and changes known to persons skilled in the art according to the spirit of the present invention are considered within the scope of the present invention as described in the appended claims.

I claim:

1. An electrical card connector, used to receive a memory card, comprising:

a metal shield defining a receiving room in which a memory card is insertable in a card insertion direction through an insert opening generally at a front end thereof;

an insulated housing shielded by the metal shield, and defining a front stepped portion and a back stepped portion, a receiving portion extending through the front stepped portion and below the back stepped portion; and a terminal module, with a shape thereof approximately similar to the shape of the receiving portion, received in the receiving portion, wherein the terminal module includes a plurality of contacts integrally insert molded in an insulator, and said insulator defines at least a first post to fasten to the housing, and a second post for mounting to a printed circuit board on which the connector is mounted.

2. The electrical card connector as claimed in claim 1, wherein said first post and said second post extend in opposite directions.

3. An electrical card connector, used to receive a memory card, comprising:

a metal shield defining a receiving room in which a memory card is insertable in a card insertion direction through an insert opening generally at a front end thereof;

an insulated housing shielded by the metal shield, and defining a front stepped portion and a back stepped portion, a receiving portion extending through the front stepped portion and below the back stepped portion; and a terminal module, with a shape thereof approximately similar to the shape of the receiving portion, received in the receiving portion; wherein the terminal module has at least one mounting pad located below a bottom face of the housing which is adapted to be seated upon a printed circuit board; wherein said the insulator of the terminal module defines a pair of protrusions to protectively receive said at least one mounting pad therebetween, and the housing defines a recess around the receiving portion to receive said pair of protrusions and said at least one mounting pad.

* * * * *